United States Patent [19]

McVey

[11] 4,342,939

[45] Aug. 3, 1982

[54] UNIVERSAL BURNING CERAMIC LAMP

[75] Inventor: Charles I. McVey, Shaker Heights, Ohio

[73] Assignee: General Electric Company, Schenectady, N.Y.

[21] Appl. No.: 145,778

[22] Filed: May 2, 1980

[51] Int. Cl.[3] ..... H01J 61/22

[52] U.S. Cl. ..... 313/174; 313/217

[58] Field of Search ..... 313/25, 174, 217, 318

[56] References Cited

U.S. PATENT DOCUMENTS

| | | | |
|---|---|---|---|
| 3,723,784 | 3/1973 | Sulcs et al. . | |
| 3,825,788 | 7/1974 | Pfaue et al. . | |
| 3,892,993 | 7/1975 | Timmermans . | |
| 4,034,252 | 7/1977 | McVey . | |
| 4,035,682 | 7/1977 | Bubar | 313/174 |
| 4,065,691 | 12/1977 | McVey | 313/217 |

*Primary Examiner*—Bruce C. Anderson

*Attorney, Agent, or Firm*—Ernest W. Legree; Philip L. Schlamp; Fred Jacob

[57] ABSTRACT

A high pressure alkali metal vapor lamp envelope of alumina ceramic having wire inleads sealed into opposite ends and no external amalgam reservoir, has an internal amalgam retention compartment for reducing sensitivity to shock and vibration. The compartment is formed by a metal partition substantially coextensive with the end wall and spaced from it a distance within the range of capillary attraction for the amalgam used. A preferred construction uses for the partition an apertured niobium disc fitting snugly in the alumina arc tube.

4 Claims, 3 Drawing Figures

UNIVERSAL BURNING CERAMIC LAMP

The invention relates to high pressure alkali metal vapor discharge lamps utilizing alumina ceramic envelopes, and more particularly to sodium vapor lamps intended for universal burning under conditions where they are subject to shock and vibration.

BACKGROUND OF THE INVENTION

The high intensity sodium vapor lamp with which the invention is most useful comprises a slender tubular ceramic arc tube which is generally mounted in an outer vitreous envelope or glass jacket. The arc tube is made of light-transmissive refractory oxide material resistant to sodium at high temperatures, suitably high density polycrystalline alumina or synthetic sapphire. The filling comprises sodium together with mercury for improved efficiency, and a rare gas to facilitate starting. The ends of the tube are sealed by closure members through which connections are made to thermionic electrodes which may comprise a tungsten coil activated by electron-emissive material. The outer envelope which encloses the ceramic arc tube is generally provided at one end with a screw base to which the electrodes of the arc tube are connected.

The high pressure sodium vapor lamp contains an excess amount of sodium mercury amalgam, that is it contains an excess amount of sodium mercury amalgam, that is it contains more amalgam than is vaporized when the lamp reaches a stable operating condition. By having an excess, the vapor pressure is determined by the lowest operating temperature in the arc tube and the quantity supplied is not critical. In long lived lamps it is customary to provide sufficient amalgam so that shifts in the sodium-mercury ratio with life due to any burnup or loss of sodium from the arc tube are negligible. In lamp manufacture, generally from 15 to 30 milligrams of amalgam with a sodium content between 10 and 30% by weight are provided.

The excess amalgam in the arc tube condenses at the cold spot whose location is determined by the heat balance in the lamp. If the lamp's orientation places the cold spot lowermost, gravity helps to retain the condensate in one place. However in universal burning lamps which are sold for operation in any orientation or attitude, the cold spot is frequently now lowermost, and with the quantity of amalgam usually provided, such lamps are sensitive to shock and vibration. Shock can cause all or part of the excess amalgam to be temporarily displaced to a hotter location, producing a sudden increase in the operating pressure of sodium and mercury which entrails a rise in voltage drop across the arc tube. The rise can be severe enough to exceed the sustaining voltage of the ballast, in which case the lamp extinguishes. When the lamp goes out in this way, commonly called drop-out, it cannot be restarted until it has cooled and that may take from 1 up to 10 minutes, depending on the ambient temperature. In extreme cases where vibration causes a droplet of amalgam from the cold spot to be projected into the very hot region forward of the electrode tip, the thermal shock on the hot ceramic may be enough to crack it. Lamp applications which are particularly difficult with regard to shock and vibration include highway bridges, loading docks, heavy machinery, and railyard lighting.

Some lamps utilize a projecting sealed-off metal exhaust type external to the arc tube proper as a reservoir for excess sodium mercury amalgam. In such lamps, sensitivity to vibration may be reduced by crimping the external exhaust tube at an intermediate point. The crimp leaves only restricted channels communicating with the reservoir portion, allowing the passage of amalgam in vapor form but preventing its movement as a liquid, as taught in U.S. Pat. No. 4,065,691—McVey, 1977. However, other ceramic lamp constructions which do not have an external metal exhaust tube cannot use that feature to reduce sensitivity to vibration. In lamps utilizing at both ends a wire seal such as taught in U.S. Pat. No. 4,034,252—McVey, 1977 and having no external amalgam reservoir, excess amalgam collects within the arc tube proper, generally at one end which the heat balance makes the cold spot. If the lamp is operated in an orientation putting such end uppermost, it may be quite sensitive to shock and vibration.

SUMMARY OF THE INVENTION

The object of the invention is to provide a means for reducing the sensitivity to vibration of alkali metal ceramic lamps of the kind wherein excess amalgam is condensed within the ceramic arc tube proper.

According to the invention, the foregoing is achieved by providing at one end of the ceramic arc tube an amalgam retention chamber formed by a metal partition which, together with the end wall or closure, creates a narrow compartment of sufficient volume to accommodate the entire excess of amalgam. The transverse dimension of the compartment, that is the spacing between end wall and partition, is chosen small enough to assure within the compartment a capillary attraction or force on the amalgam several times greater than the force of gravity. The partition extends substantially to the side walls of the arc tube but need not make a hermetic seal. A small aperture through the partition is desirable in any case to allow the amalgam to pass in or out of the compartment in vapor form.

In a preferred construction, the partition wall is a thin metal disc of niobium or molybdenum making a snug fit within the arc tube and having a central hole through which the electrode inlead extends. The disc is spaced from the end closure by a thin spacer and is held against the spacer by a wire loop which provides thermal isolation between the electrode proper and the seal through the end closure.

DETAILED DESCRIPTION

The inner envelope or arc tube 1 embodying the invention is suitable for a 400 watt high pressure sodium vapor lamp. It comprises a length of light-transmitting ceramic tubing 1, suitably polycrystalline alumina ceramic which is translucent, or single crystal alumina which is clear and transparent. The ends of the arc tube are closed by end closures consisting of alumina ceramic plugs 2,2' through which extend hermetically niobium inlead wires 3 which support the electrodes.

The ceramic plugs are sealed to the ends of the tube, and the niobium conductors are sealed through the plugs, by means of a glassy sealing composition comprising alumina and calcia which is fused in place.

Figure 1:
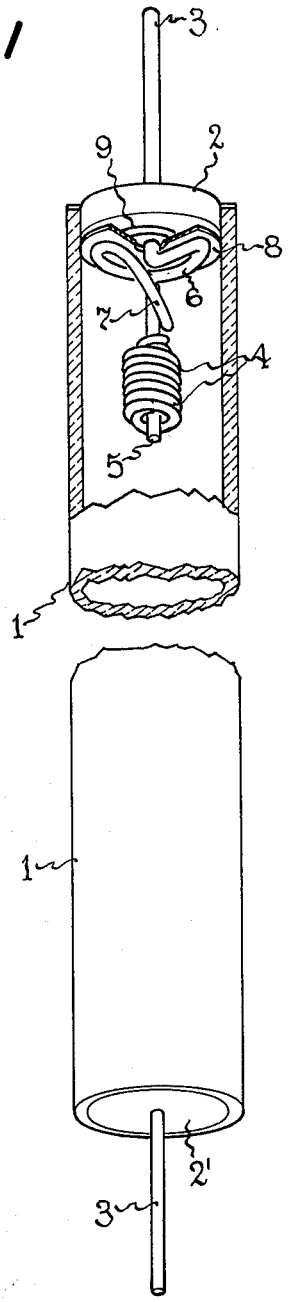
FIG. 1 shows the ceramic arc tube of a high pressure sodium vapor lamp embodying the invention and having the upper end cut open to show the amalgam retention compartment.

The electrode at the upper end of the arc tube is illustrated in FIG. 1 and the other one is substantially identical. The electrode comprises tungsten wire 4 coiled on a tungsten shank 5 in two superposed layers. The outer layer as shown is close wound but the inner layer may have spaced turns and electron emitting material, suitably $Ba_2CaWo_6$ enclosed in the interstices between turns. The inner end of inlead 3 is bent sharply to a radial direction immediately beyond the hole through plug 2 and then curves into a ring-like loop 6 which terminates in an inwardly and downwardly directed extension to which shank 5 of the electrode is welded at 7. The feature of loop 6 which provides thermal isolation between the electrode and the inlead seal and also serves as a platform to support ceramic plug 2 prior to sealing is more fully described in U.S. Pat. No. 3,992,642—McVey and Kelling, 1976.

In accordance with my present invention an amalgam retention compartment is provided at the end of the arc tube where the heat balance locates the cold spot, such being the upper end in FIG. 1. A metal disc 8, suitably of molybdenum provides a partition wall closely spaced from the end wall, that is from the inside surface of ceramic plug 2. The transverse dimension in the retention compartment, that is the spacing between end wall and partition, is within the range of capillary forces for sodium-mercury amalgam, namely 0.040" (1 mm) or less, a preferred spacing being 0.015" (0.6 mm). The niobium inlead 3 passes through the central hole in disc 8 and the disc rests against the ring-like loop 6. A washer 9 encircling the inlead passing through the compartment serves as a spacer between partition and end wall. The washer is conveniently made of niobium wire of appropriate size for the spacing or transverse dimension desired, for instance 15 mil wire cut to length and formed into a ring for a 0.015" spacing.

When the end plug and electrode assembly together with the partition disc 2 is about to be sealed into the end of the ceramic tube, it is supported in the open end of the tube by a light crosspiece (not shown) spot-welded to inlead 3 just above the plug. Sealing composition is placed on the ceramic plug, suitably as a slurry, and the assembly is then heated to the melting temperature of the composition or glass frit. As the molten frit is drawn by capillary action into the crevice between ceramic tube and plug and that between plug and inlead, some may contact the outer edge of the partition disc and seal it in place upon cooling, at least in part. For this reason, partition disc 8 should be close to a match to the alumina ceramic. If not a match, the coefficient of expansion of the partition disc should preferably be less than that of the alumina ceramic. I have used niobium and molybdenum for the disc and have found both suitable.

Prior to sealing the second end plug and electrode assembly into the end of the ceramic tube, a sodium-mercury amalgam charge is put into the tube. The sealing operation itself is carried out in a vessel containing the inert gas selected for the starting gas in the finished lamp. The inert gas is at a pressure that will result in the desired pressure in the sealed arc tube. A portion of the arc tube may be cooled to prevent vaporization of the amalgam while the end to which the plug is being sealed is heated electrically or by radiant energy.

Arc tube 1 illustrated in FIG. 1 is usually made into a lamp by mounting it within an outer glass envelope or jacket provided with a screw base at one end. The jacket is evacuated or filled with an inactive gas prior to sealing, and has inleads passing through a stem which are connected to the electrodes of the arc tube on one side and to the shell and end contact of the base on the other. Reference may be made to my U.S. Pat. No. 4,034,252 for a complete description of a jacketed lamp. In a universal lamp, there is no restriction on the attitude or orientation of the lamp when accommodated in a fixture.

Since an arc tube using wire seals at both ends is symmetrical end for end, it may readily be designed with a heat balance that places the cold spot at whatever end of the lamp is lowermost for the chosen orientation in the fixture. My invention in such case may provide a partition disc at each end of the lamp. In operation, the amalgam retention chamber at the end of the arc tube which is lowermost is that used and which effectively reduces the sensitivity to vibration. Alternatively the lamp may be designed to have one end decidedly hotter in order to require an amalgam retaining compartment at that end only.

Figure 2:
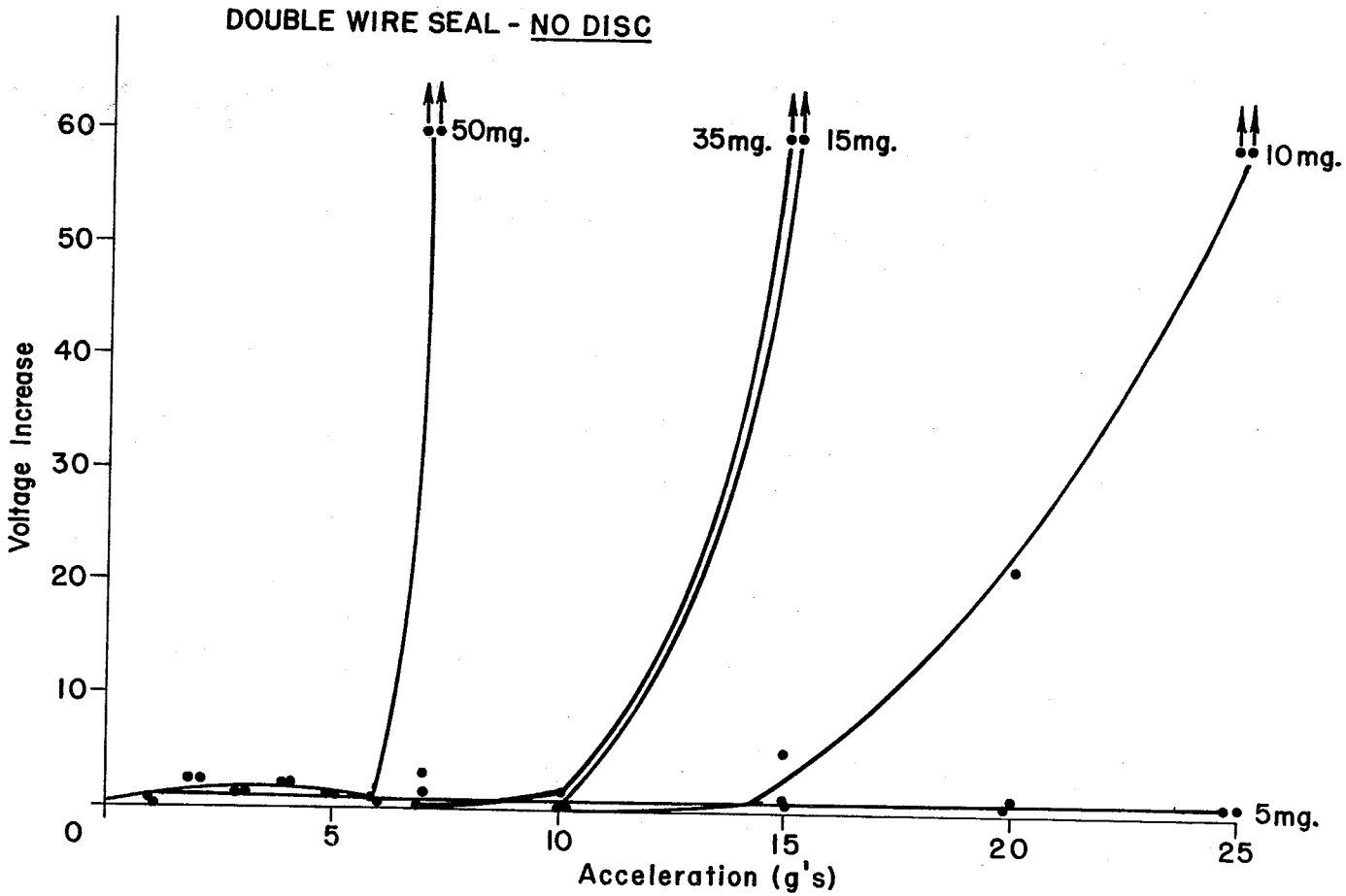
FIG. 2 is a graph showing the sensitivity to shock of conventional lamps.
Figure 3:
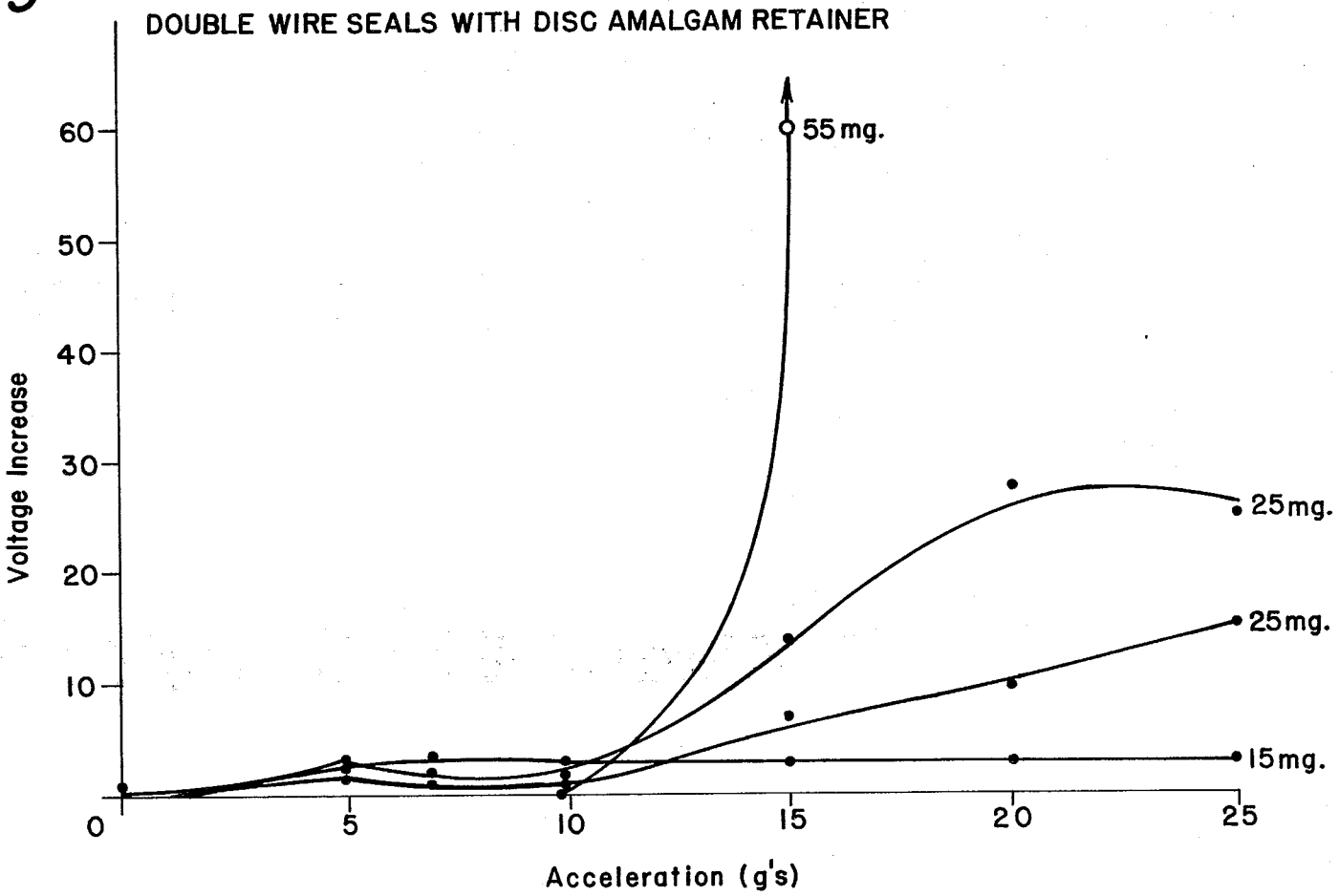
FIG. 3 is a graph showing the reduction in sensitivity achieved by the invention.

The effectiveness of my invention in reducing sensitivity to shock or vibration is readily seen from FIGS. 2 and 3 which compare voltage rise in sand drop shock testing of lamps. For these tests, similar lamps having a wire seal at each end were used and the comparison was made between lamps not having and lamps having the amalgam retention compartment of the invention. In the latter lamps, the design utilized a spacing or transverse dimension of 0.015" in the compartment, and the amalgam comprised from 17% to 25% Na by weight. The machine used in the tests comprises a falling platform guided by vertical rails and having a variable number of wooden blocks attached to its underside that penetrate sand within a box. The magnitude and duration of the stopping acceleration (deceleration) are determined by the height of the drop and the number of blocks used. In these tests, 2 blocks were used resulting in a 20 millisecond deceleration or shock duration. The sand used was 30 to 40 grit kiln-dried silica sand and it was carefully maintained as to depth, packing and surface condition in accordance with machine manufacturer's instructions (Barry Corporation, Model 20 VI Shock Machine, Watertown, Mass.) After each drop, the sand was raked in prescribed manner and carefully levelled, the platform lowered to the sand surface to reset the zero point and check the level, and the platform then raised to the desired drop height.

The lamps were mounted on the platform in vertical attitude and with the cold spot end uppermost. For these tests the lamps were operated with a foil reflector about the base in order to force all amalgam to relocate quickly to the upper end of the arc tube, and the lamps were restabilized in operation for several minutes before each drop. The height of the drop was increased at each test up to the occurrence of extinguishment. Any voltage change upon impact was recorded with conventional meters; the results are plotted in FIGS. 2 and 3. The weight of the sodium-mercury amalgam charge in the lamp is indicated close by the upper voltage end of each curve. An up-pointing arrow at the top of a voltage rise curve indicates that the voltage rise extinguished the lamp. In consistencies in the curves are explainable by the fact that suspended or trapped drops or pools of amalgam are somewhat unstable in form and not always uniform in their response to dislodging forces.

Referring to FIG. 2, it is seen that with a 50 mg amalgam charge, an acceleration of 7 g's will cause the lamp to extinguish. However, referring to FIG. 3, when the amalgam retention compartment of the invention is present, 15 g's can be withstood before extinction occurs even when using a slightly larger 55 mg charge. When the amalgam charge is reduced to more conventional quantities such as the range of 35 mg to 15 mg, extinction occurs in conventional lamps but not in lamps having the amalgam retention compartment. In fact, it is seen in FIG. 3 that with a 15 mg charge in a lamp embodying the invention, the voltage rise is insignificant even with an acceleration of 25 g's . An acceleration of this magnitude exceeds what is encountered in practice and would in any event probably wreck the fixture in which the lamp is mounted. Thus it is seen that the amalgam retention compartment of my invention provides a convenient and economical means for increasing the ability of the lamp to withstand shock and vibration up to a level beyond which there is no benefit in going.

What I claim as new and desire to secure by Letters Patent of the United States is:

1. An alkali metal vapor lamp comprising:

a tubular elongated envelope of light-transmitting ceramic material having a pair of electrodes supported in opposite ends on wire inleads sealed through ceramic end plugs, an ionizable medium including mercury-alkali amalgam sealed within said envelope in a quantity exceeding that vaporized during operation of said lamp, the heat balance in said lamp locating the cold spot at an end of said envelope, and an amalgam retention compartment in the cold spot end of said envelope serving as a reservoir for excess amalgam, said compartment being formed by a metal partition substantially co-extensive with the end plug and having an aperture through which the inlead sealed through the end plug extends, said partition being supported by the inlead and spaced a distance within the range of capillary forces for said amalgam from the inside surface of the end plug.

2. A lamp as in claim 1 wherein the spacing between said partition and said end plug is 1 millimeter (0.040") or less.

3. A lamp as in claim 1 wherein said partition is a thin metal disc having a central aperture through which the inlead sealed through the end plug extends, the inlead being curved into a ring-like loop immediately beyond the aperture, the disc contacting said loop on one side and being spaced from the end plug by a washer on the other side.

4. A lamp as in claim 3 wherein said disc is of niobium or molybdenum.

* * * * *